US006530417B2

(12) United States Patent
Erana

(10) Patent No.: US 6,530,417 B2
(45) Date of Patent: Mar. 11, 2003

(54) CAM DEVICE FOR REMOVING AND TILTING THE FRONT PLATE IN A VERTICAL MOLD CASTING MACHINE

(75) Inventor: Augustin Arana Erana, Vitoria (ES)

(73) Assignee: Loramendi, S.A., Alava (ES)

( * ) Notice: Subject to any disclaimer, the term of this patent is extended or adjusted under 35 U.S.C. 154(b) by 0 days.

(21) Appl. No.: 09/958,103

(22) PCT Filed: Feb. 8, 2001

(86) PCT No.: PCT/ES01/00037

§ 371 (c)(1),
(2), (4) Date: Jan. 3, 2002

(87) PCT Pub. No.: WO01/59299

PCT Pub. Date: Aug. 16, 2001

(65) Prior Publication Data

US 2002/0157803 A1 Oct. 31, 2002

(30) Foreign Application Priority Data

Feb. 9, 2000 (ES) ..... 20000289 U

(51) Int. Cl.[7] ..... B22C 9/20; B22C 15/24
(52) U.S. Cl. ..... 164/200; 164/322
(58) Field of Search ..... 164/18, 27, 322, 164/323, 324, 328, 200, 201, 202

(56) References Cited

U.S. PATENT DOCUMENTS

| | | | | |
|---|---|---|---|---|
| 3,999,594 | A | 12/1976 | Gunnergaard | 164/187 |
| 4,267,878 | A | 5/1981 | Mogensen et al. | 164/187 |
| 4,721,148 | A | 1/1988 | Knudsen | 164/187 |

FOREIGN PATENT DOCUMENTS

| | | |
|---|---|---|
| GB | 1461850 | 1/1977 |
| WO | WO 00/67934 | 11/2000 |
| WO | WO 00/69584 | 11/2000 |
| WO | WO 00/76691 | 12/2000 |

*Primary Examiner*—Kuang Y. Lin
(74) *Attorney, Agent, or Firm*—Welsh & Katz, Ltd.

(57) ABSTRACT

The object of the device is to provide a novel cam device applicable to sand molding machines in which the cam (1) has its active surface (2) facing downwards to prevent sand or dirt from being deposited between said cam (1) and the its supporting follower (10), which the machine is provided with to cause the swivelling of the said cam. For this purpose the cam (1) is hinged at a point (3) to a frame (4) which may move longitudinally, while on another point (5) it is hinged to a connecting rod (6) which is in turn hinged on its opposite end at the point (8) to the front swinging plate (7) of the sand mote molding machine, with said front plate (7) hinged at the point (9) on its rearmost edge to the frame (4).

2 Claims, 4 Drawing Sheets

CAM DEVICE FOR REMOVING AND TILTING THE FRONT PLATE IN A VERTICAL MOLD CASTING MACHINE

OBJECT OF THE INVENTION

The present invention relates to a cam device for the extraction and swinging of the front plate in a vertical sand molding machine, designed to prevent sudden changes in the movements of the plate during its displacement and swivelling, in order to allow the extraction of each sand mold and its prior conformation or molding.

The object of the invention is to provide a new cam device applicable to sand molding machines with the aforementioned object, in which the active surface of the cam faces downwards to prevent the deposit of sand or dirt between said cam and its supporting follower incorporated in the machine to achieve its swivelling.

BACKGROUND OF THE INVENTION

Sand molding machines in which the production and output of the molds is in a vertical position are provided with a generally rectangular chamber in which the sand is blown through a hopper or bell placed on the top, which chamber is closed on one end by a displaceable and swinging plate which allows the exit of the molded mold, while the other end is closed by a rear plate associated to a compacting piston, which is also used to push on the mold and expel it in order to place said mold on the stack of previously produced molds.

The mold is obtained by blowing sand in the chamber, followed by compacting the sand with the combined press of both plates. After this the swinging plate is opened and swivelled to allow the mold to exit, which is achieved by pushing with the rear plate associated to the pushing piston. Thus the mold is extracted and placed on the previously obtained pile.

Currently, the swinging plate is opened and closed by a variety of driving mechanisms, among which may be mentioned one comprising a cam which rests by its top surface on a follower, so that said cam is connected to the swivelling plate to produce the swivelling of the plate as the cam moves and rests on the follower.

The arrangement of this cam with its active face facing upwards, and therefore with the follower on top results in sand being deposited between these elements which may damage the mechanism, and which thus require periodic cleanings to prevent this damage. Additionally, the known mechanisms which are based on the action of a cam are constructed such that there are sudden changes in the motion of the plate.

DESCRIPTION OF THE INVENTION

The device disclosed has been designed to solve the aforementioned problems by means of a simple yet effective solution, considering the loads supported by the device components to prevent sudden changes in the plate motion during its operation.

More specifically, the device of the invention comprises a cam with its active surface facing downwards, so that its follower is on the bottom and the formation and deposit of dirt between them is thereby prevented.

Said cam is jointed on one side to a frame which may move longitudinally, which in turn is jointed to the swivelling front plate, while on the other side the cam is jointed to a connecting rod, which is in turn jointed on its opposite end to the swinging plate. These joints of the aforementioned elements determine a cross-linkage of four bars by which the motion of the cam becomes a displacement and swivelling of the swinging front plate, thereby allowing the exit of the sand mold.

The moving frame connected to the cam is driven by interposing bars with a cylinder placed opposite the drive cylinder for the rear plate, producing a motion in either sense of the frame itself. Initially, a push of the cylinder will only cause the longitudinal displacement of the front plate and its extraction, until the cam reaches the follower, at which time if the cylinder continues to push the cam will begin to swivel, pushing the connecting rod and in turn the front plate, thus making the latter swing to allow exit of the mold.

DESCRIPTION OF THE DRAWINGS

The characteristics of the invention will be better understood in view of the accompanying drawings of a preferred embodiment, where for purposes of illustration only the following is shown.

PREFERRED EMBODIMENT OF THE INVENTION

Figure 1:
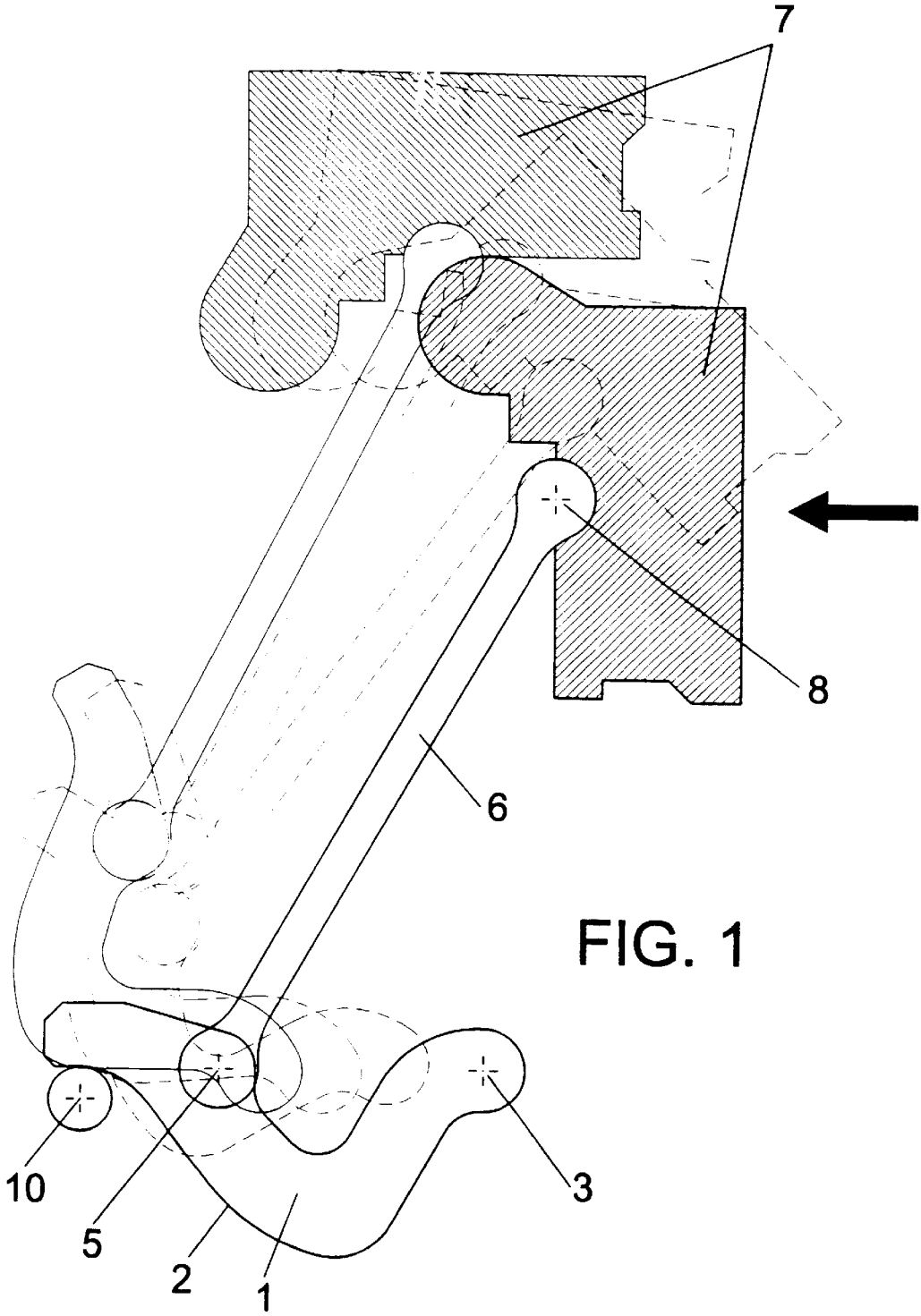
FIG. 1 shows a side view of the cam device in several positions of the cam between its resting position and the final swivelling position.

As may be seen in the above described drawings, the device of the invention comprises a cam (1) whose active surface (2) is facing downwards, jointed by one of its points (3) to a frame (4) which may move longitudinally, while by another point (5) far from the. previous one the cam (1) is jointed to a connecting rod (6), which on its opposite end is in turn jointed at the point (8) to the front swinging plate (7) of the sand mold molding machine, with said front plate (7) hinged at the point (9) at its rearmost edge to the frame (4).

Said device is repeated at either end of the machine so that the movements are perfectly balanced.

The molding machine to which this device is applicable is, provided with the corresponding molding chamber in which the mold (11) is formed, above which is placed the hopper of bell (12) by which the sand is blown. The swinging plate (7) closes the front part of the chamber, while the rear part is closed by a second plate (13), the displacement of which is driven by a cylinder (14), with a further cylinder (15) driving the movable frame (14) by means of, the bars (16).

Figure 2:
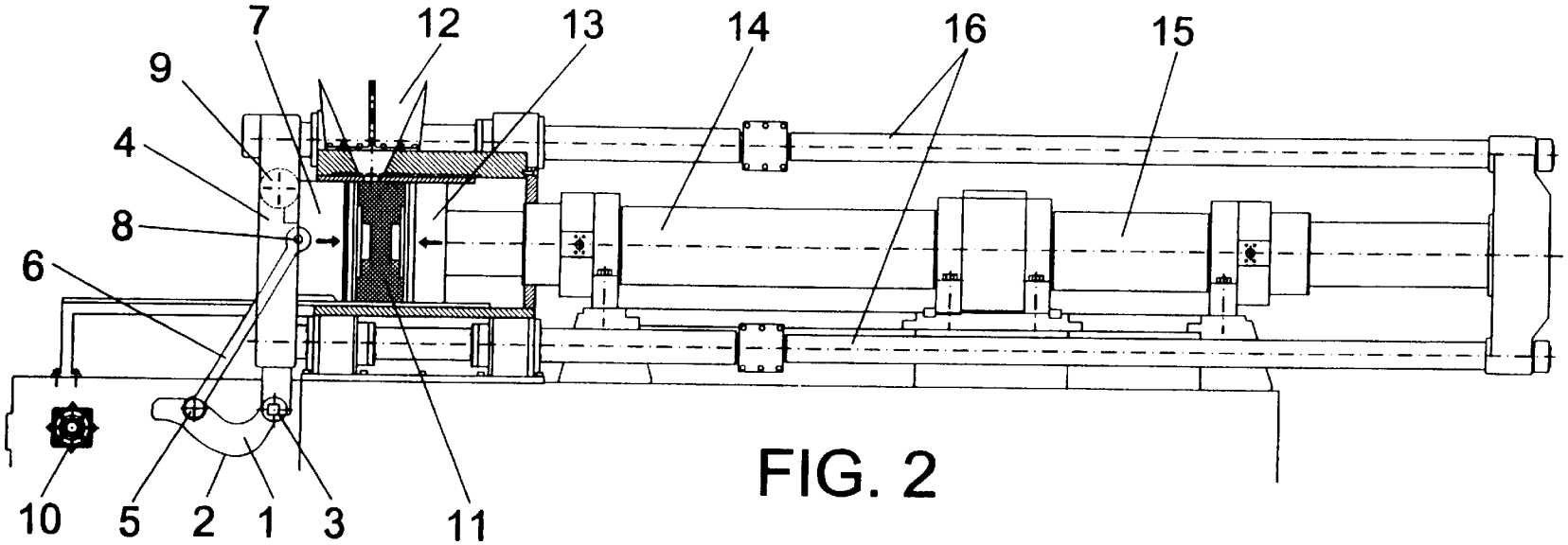
FIGS. 2, 3 and 4 show views corresponding to three stages of the motion of the cam device object of the invention.
Figure 3:
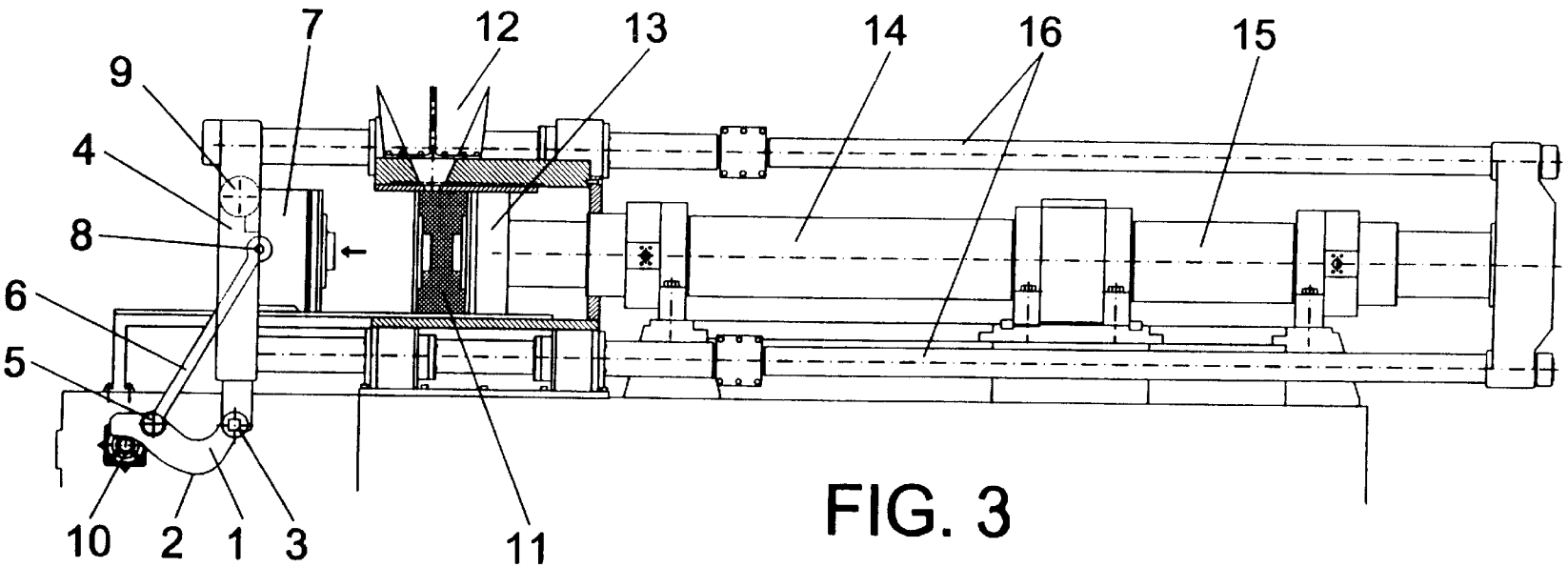
Figure 4:
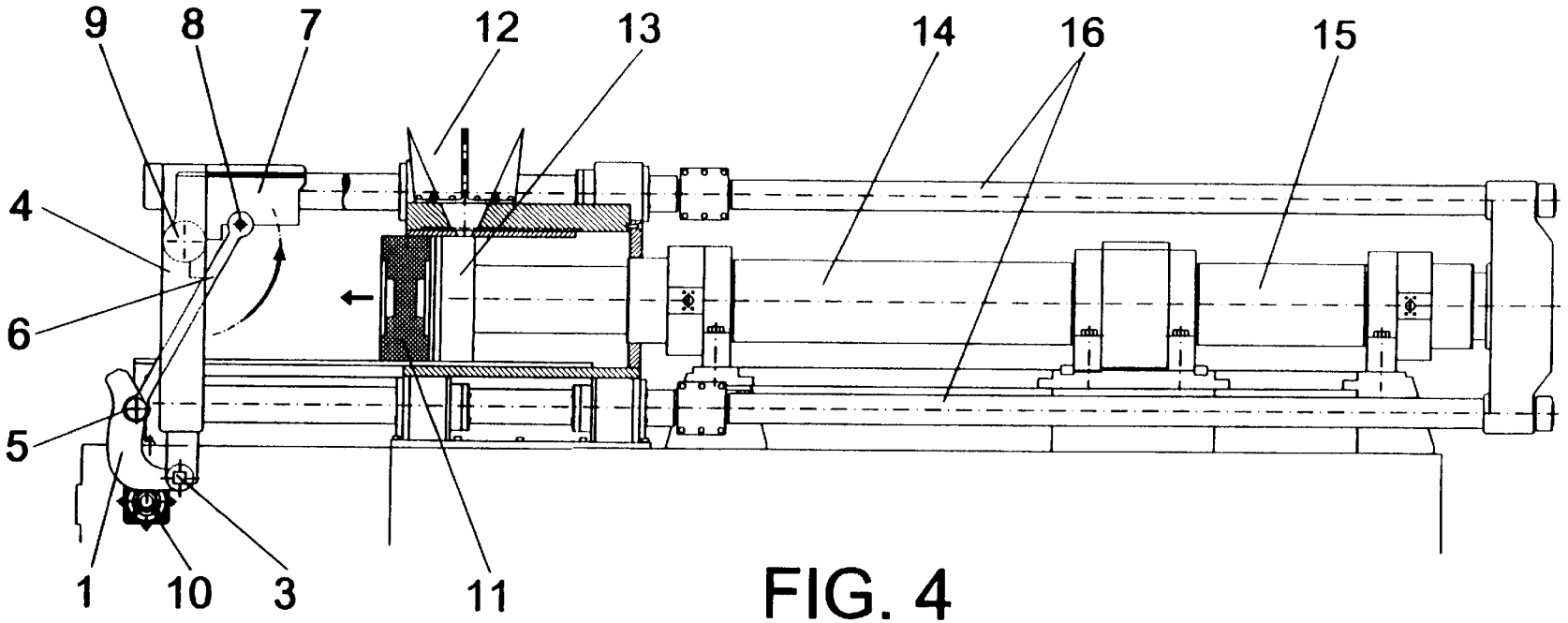

In accordance with this and in view of the FIGS. 2, 3 and 4, the operational sequence of the machine and therefore of the device of the invention is as follows:

After the sand is blown on the molding chamber the corresponding compression is performed by the simultaneous and opposing action of the cylinders (14) and (15), which push the plates (7) and (13) to form the mold (11) in the molding chamber.

After this the cylinder (14) stops acting and the cylinder (15) inverts its action, causing the longitudinal and outwards displacement of the frame (4) and therefore of the plate (7), so that this displacement will eventually make the active surface (2) of the cam (1) contact the follower (10). After this moment if the movement continues the cam will swivel upwards pushing on the rod (6) and therefore pushing and swivelling the plate (7) about its hinge (9) with respect to the frame (4). This swivelling motion continues until the plate (7) is in a horizontal position at its top, as shown in FIG. 3, at which position the mold (11) may be extracted by the pushing action of the plate (13), which plate is driven and moved longitudinally by the cylinder (14).

What is claimed is:

1. A vertical sand molding machine comprising a cam device for extraction and swinging of the front plate of said vertical sand molding machine, said machine having a molding chamber in which sand is blown to obtain the mold, which chamber is closed on one end by a swinging front plate which allows to extract the mold, while on the other end it is closed by a rear plate which also acts as a rammer to extract the mold, with said rear plate driven by a cylinder, such that the swiveling front plate is related to a cam which when driven results in the swinging of the front plate; characterized in that the cam has its active surface facing downwards, so that it acts above a supporting follower provided on one side of the machine, with the said cam hinged on one of its ends to a longitudinally displaceable frame, while on another point distant from this the cam is also hinged to a connecting rod which on its opposite end is in turn hinged to the swinging front plate, which plate is also hinged on its rear end to the displaceable frame; thus, the movement of the frame causes the displacement and extraction of the front plate until the cam touches the follower, at which time the movement of the frame causes the swiveling of the cam and the ensuing push through the connecting rod on the swinging central plate, until this plate reaches an upper horizontal position which allows to extract the mold.

2. The cam device for extraction and swinging of the front plate in the vertical sand molding machine, as claimed in claim 1; characterized in that the displaceable frame which is hinged to the cam is associated to longitudinal bars which are driven by a cylinder opposed to the cylinder which drives the rear plate, such that when the former cylinder acts in opposition to the cylinder which drives the rear plate the sand mold is compacted, while when it acts in the same sense the front plate is moved and extracted.

* * * * *